United States Patent [19]

Payne

[11] Patent Number: 4,964,249

[45] Date of Patent: Oct. 23, 1990

[54] FOLDABLE PLAYHOUSE WITH CONTAINER-FORMING ROOF

[76] Inventor: Mark B. Payne, 4017 Ninth Ave., Huntsville, Ala. 35805

[21] Appl. No.: 408,373

[22] Filed: Sep. 18, 1989

[51] Int. Cl.[5] ..... E04B 7/16

[52] U.S. Cl. ..... 52/70; 446/478; 446/75; 52/DIG. 13

[58] Field of Search ..... 446/478, 75, 80, 82, 446/476, 110; 52/70, 71, 79.5, 66

[56] References Cited

U.S. PATENT DOCUMENTS

| | | | |
|---|---|---|---|
| 2,837,777 | 6/1958 | White | 446/478 X |
| 3,456,380 | 7/1969 | Cameron | 446/80 |
| 3,719,001 | 3/1973 | Archer | 446/476 X |
| 4,035,964 | 7/1977 | Robinson | 52/70 X |
| 4,067,137 | 1/1978 | Korthase | 446/448 |
| 4,467,572 | 8/1984 | Somers et al. | 52/70 |

OTHER PUBLICATIONS

"Self-Storing Doll House", Popular Mechanics, Nov. 1962, pp. 158–159.

*Primary Examiner*—Mickey Yu

*Attorney, Agent, or Firm*—Phillips & Beumer

[57] ABSTRACT

A foldable children's playhouse having a box beam integral with one or two roof panels is disclosed. The box beam has a U-shaped cross section, with the integral panels being foldable along a line extending longitudinally at the open end of the box beam. In a preferred embodiment, walls of the playhouse are made up of two units, each including a rectangular side wall and an end wall having a rectangular bottom portion and a triangular gable portion that folds along the top of the bottom portion. The roof is attachable to the walls by placing it in alignment over the walls and engaging top edges of the walls with channels on the underside of the roof so as to obtain a force fit. Means such as Velcro fasteners are provided on overlapping surfaces for securing the wall units to one another. A rail for strengthening the roof is disposed around the edges of and underneath the roof, the rail being obtained by folding over of edge regions to provide a support member having a triangular cross section. The box beam and integral panels when folded flat form a receptacle for containing the wall panel units in folded, stacked position.

8 Claims, 3 Drawing Sheets

FOLDABLE PLAYHOUSE WITH CONTAINER-FORMING ROOF

FIELD OF THE INVENTION

This invention relates generally to children's playhouses and more particularly to playhouses that fold up for storage.

BACKGROUND OF THE INVENTION

A need exists for foldable children's playhouses that may be easily erected and disassembled for storage in compact form. This would allow the playhouse to be moved readily to various locations both inside and outside. Desirable features for such playhouses include a structure having a minimum number of parts to be lost or misplaced and sturdiness and high strength when assembled. Preferably the walls should to the maximum extent be made of integral pieces that fold along vertical lines for assembly and disassembly. Storage would be facilitated by providing a structure that allows portions of the house to serve as a container capable of enclosing the remaining parts in compact, fold-up condition so that there would be no need for a separate storage or shipping container.

Various foldable playhouse structures are disclosed in prior art patents. U.S. Pat. No. 3,231,942 discloses a structure having a pair of side walls and a pair of end walls, the end walls being made up of two halves hinged together so as to fold together along a vertical line at the middle thereof. The roof includes two halves each having a pitched roof section hinged to a flat roof section, the roof being separable along the top between the adjoining flat roof sections. Trapezoidal gables that extend upward from the end walls support the roof sections, and U-shaped channels are provided in the underside of the roof sections to receive top edges of the gables. U.S. Pat. Nos. 3,977,119 and 4,190,978 disclose a playhouse made up of two equal parts, each part including a rectangular side wall, two half end walls, and a roof, all of these parts connected along fold lines. The structure shown in these patents have their ends walls and roofs each made up of separate parts so that their weakest points are along top of the roof and the vertical line between parts of the end walls. It is desired to provide a foldable playhouse with an integral roof that includes a reinforcing beam on its top to provide high strength and to avoid having end walls that are made up of two parts. In addition, the playhouse assembly should fold to a compact, self-contained package for storage and/or shipping.

SUMMARY OF THE INVENTION

The present invention is directed to a foldable children's playhouse including wall panels and a roof that engages upper edges of the wall panels, the roof having a longitudinally extending beam at the top and, integral therewith, roof sections that are foldable outward and downward from the beam. The roof beam and integral sections when disengaged from the wall panels provide a generally U-shaped container that receives the wall panels in folded up condition for storage. Wall panels may be provided in two units, each unit including a rectangular side panel and an end panel having a rectangular bottom portion, a generally triangular gable portion integrally formed with the top of the bottom portion, and foldable upward along a horizontally extending hinge line. Means are provided for connecting the wall panel unit to one another and engaging the tops thereof with edge portions of the roof. In an alternate embodiment, the box beam has an integral roof portion forming a flat roof and a side portion forming a first side wall, the box beam and integral roof and side providing a container for the remaining parts in folded-up condition. Structures embodying the invention avoid having a seam in the roof or end walls, resulting in increased sturdiness as well as ease of assembly and disassembly.

DESCRIPTION OF THE PREFERRED EMBODIMENT

Figure 1:
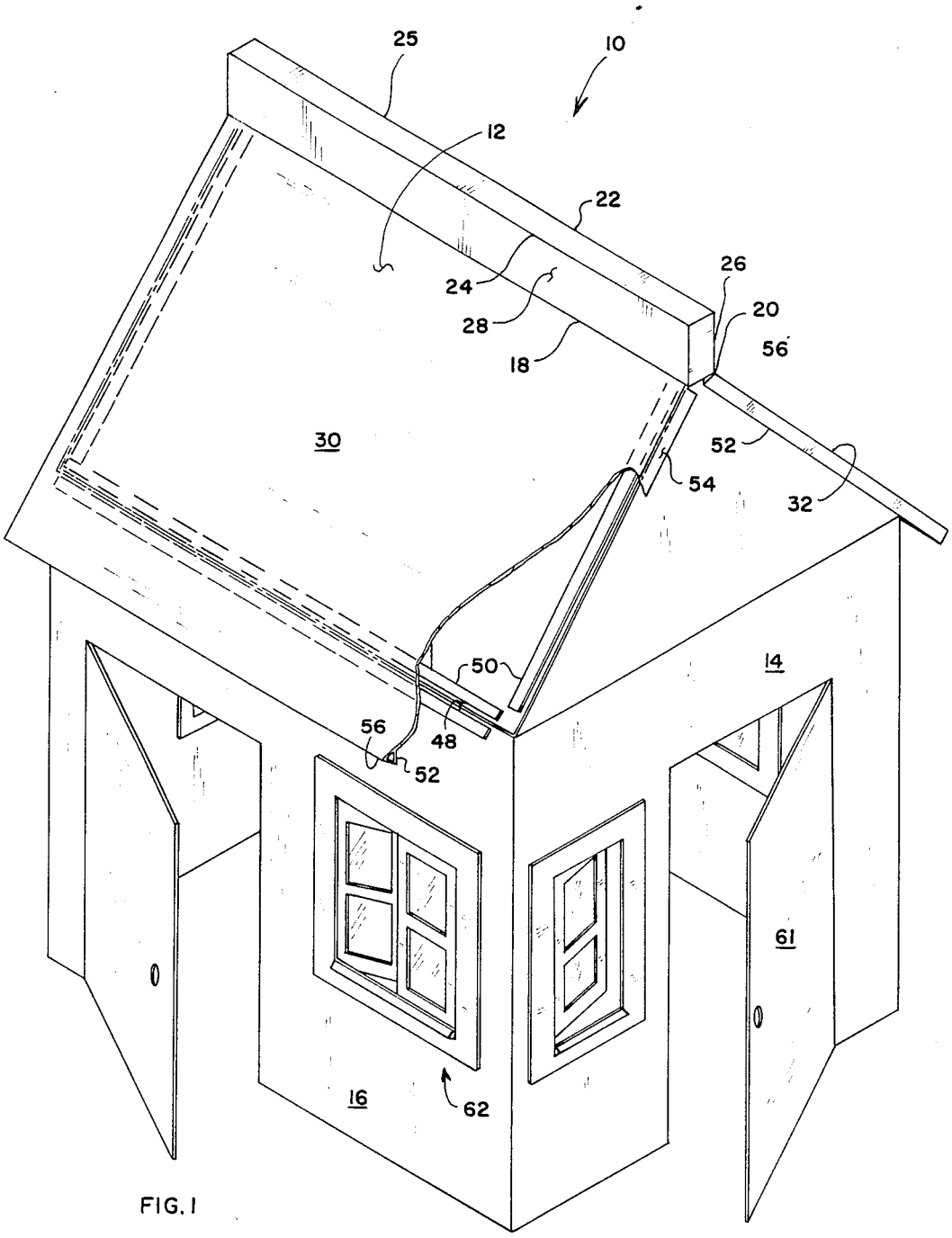
FIG. 1 is a pictorial view, partly broken away, showing a playhouse embodying the invention.

Referring to FIG. 1 of the drawings, there is shown a foldable playhouse 10 in assembled condition. The playhouse is made up of material such as cardboard in three parts: a roof portion 12 and wall portions 14 and 16, each of which includes an end wall and a side wall integral therewith. The roof is made of a single piece of cardboard that is folded along longitudinally extending lines 18, 20, 22, and 24. These lines define a box beam 25 of U-shaped, rctangualr cross section. Sides 26 and 28 of the box beam are spaced apart a distance such as to receive the thickness of the walls of the playhouse when folded and stacked. Roof portions 30 and 32, integral with the box beam, are rectangular in shape and foldable outward from one another, and they are sized so as to extend past the upper edges of the side walls when in assembled condition as shown.

Figure 2:
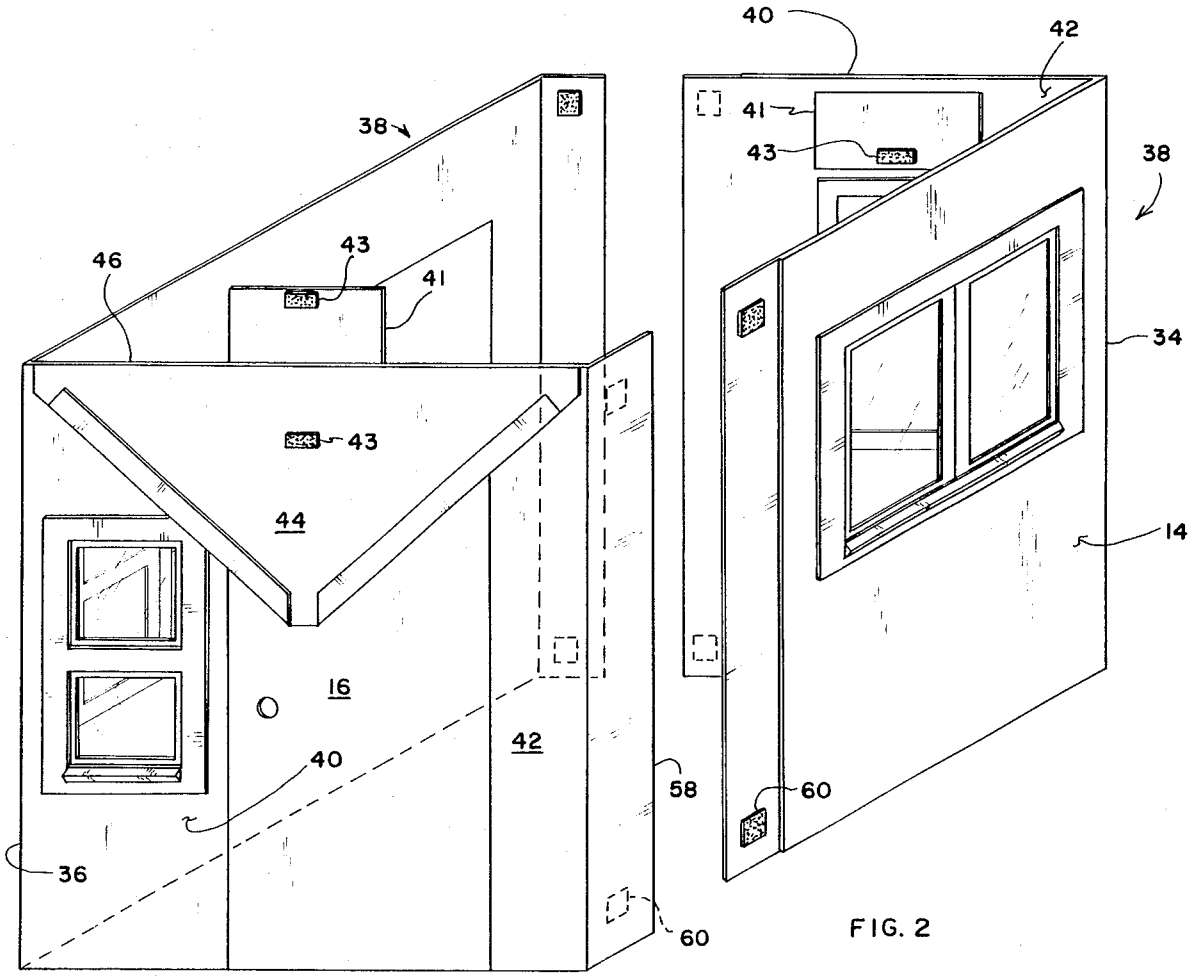
FIG. 2 is a pictorial view of wall portions of the playhouse shown slight spaced apart.

Integral side and end wall portions 14 and 16 are foldable along vertical lines 34 and 36 (FIG. 2), providing side walls 38 and end walls 40 disposed upright at right angles to one another when assembled. Side walls 40 are rectangular in shape, while the end walls have a rectangular bottom part 42 equal in height to the height of the side walls and a generally triangualr gable 44 integral with the end walls and foldable upward along horizontal line 46 defined by the top edge of bottom part 42.

The underside of roof portions 30 and 32 have defined therein channels 48 around their periphery adapted for being engaged with the top edges of side walls 40 and gables 44. The channels may be provided by strips 50 secured to the roof and extending along the length of the joint and spaced apart a distance such as to provide a frictional fit when forced into position over side wall and gable edges. Edges of the roof portions have rails 52 extending along the length on their undersides to provide further strength of the house. The rails have a triangualr cross section and are integral with the roof, being formed by folding over edge strips along lines to produce rail faces 54 and 56.

Side and end wall portions 14 and 16 may be removably secured to one another by means of vertically extending flaps 58 folded over from and integral with a side edge, with Velcro TM (hook and loop type) fasterners 60 being disposed in matable relation on surfaces of the flaps that overlap side edge portions of the adjoining wall portion.

The plathouse may include a door 61, windows 62, and other decorative features as desired. The door and windows would be provided by cutting out their upper and lower edges, leaving one side attached along the vertical line around which the door or window may be rotated as shown in FIG. 1. Art work simulating various styles of houses or fanciful figures that are attractive to children and may also be provided by painting or pasting on of decorative material on the exterior or interior surface.

End walls of the playhouse may be reinforced by providing foldable tabs 41 near the upper edge of the bottom part 42 of the walls, the tabs being foldable upward across fold lines 46 with Velcro fasteners 43 on the tabs and gable surface securing them in place.

Figure 3:
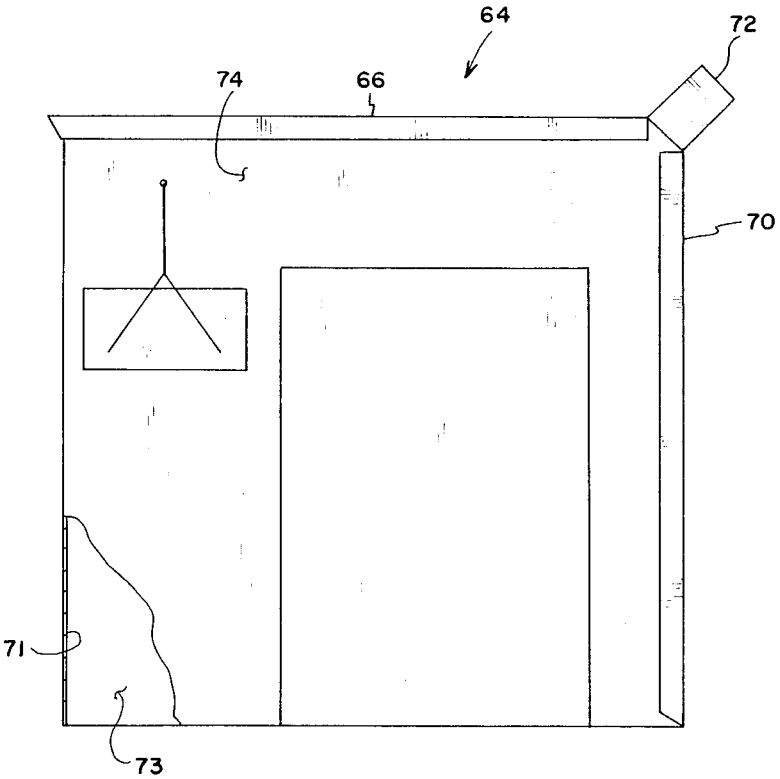
FIG. 3 is a pictorial view of a flat-roofed embodiment of the invention.

FIG. 3 shows an embodiment wherein a playhouse 64 has a flat roof 66 made up of a foldable wing corresponding to roof portion 30 of FIG. 1, the other roof section 32 of FIG. 1 forming a side wall 70 in this embodiment. Roof 66 and wall 70 are integral with box beam 72, which extends longitudinally along one side of the roof. Front wall 74, the side wall 71 opposite wall 70, and the rear wall 73 are integral with one another and foldable along adjoining corner lines. Connections between the roof and side walls integral with the box beam and the other side walls may be effected by providing channels on the underside of the roof and on the inside of side wall 70 to receive the other side walls in the same manner described for the embodiment of FIG. 1.

Figure 4:
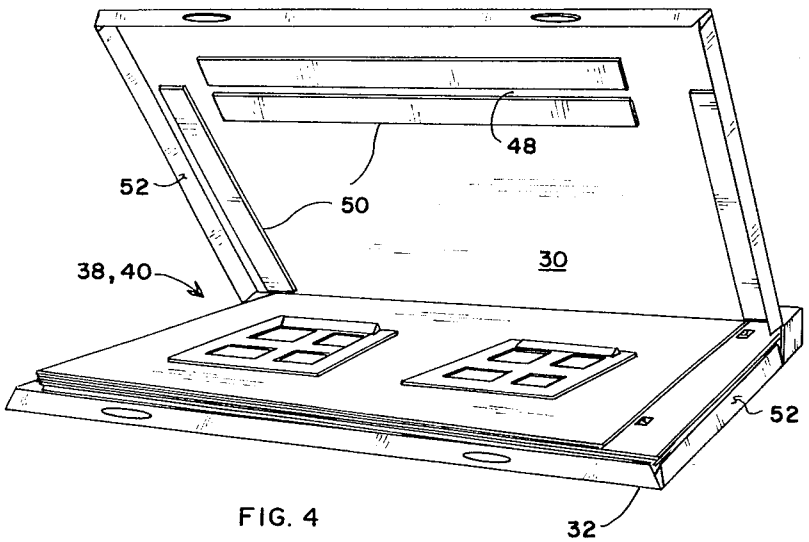
FIG. 4 is a pictorial view of showing the playhouse roof partially folded up, with walls stowed therein.
Figure 5:
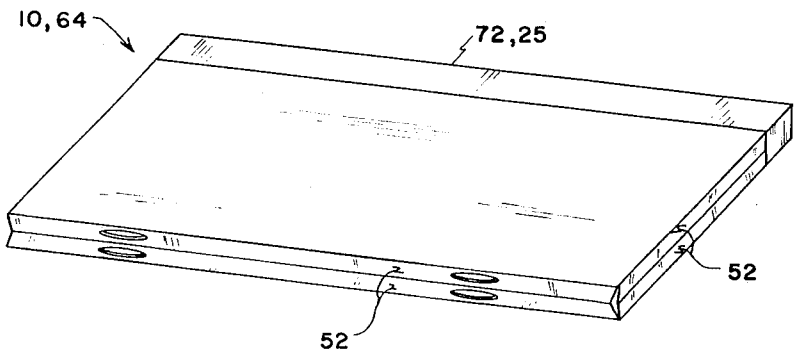
FIG. 5 is a pictorial view of the playhouse roof fully folded to provide a container.

FIG. 4 shows the playhouse roof partially folded with walls 38 and 40 folded together and placed inside edge rails 52 of roof portion 32. The fully folded container provided by the roof structure is shown in FIG. 5.

The playhouse is preferably constructed of corrugated cardboard although other material such as plywood, presswood, or particle board may also be used. Edges around doors and elsewhere may be strengthened and made more safe by covering them with suitable tape.

In assemblying the playhouse, the walls are unfolded, placed in upright position, and joined together as required with the walls at upright angles to one another. The roof is then placed in proper alignment and forced downward so that channels on its underside receive the upper edges of the side walls and gables. The mating parts may be snapped together to provide a force fit that holds the playhouse securely in position.

While the invention is described above in terms of specific embodiments, it is not to be understood as so limited but is limited only as indicated by the appended claims.

I claim:

1. A foldable children's playhouse comprising:

a roof comprising a box beam and a pair of roof panels, said box beam including an elongated rectangular top member and a pair of rectangular side members, each side member having a lower edge and being connected to a side of said top member and disposed perpendicular thereto, and each of said roof panels being foldably secured to a side member along the lower edge thereof;

a pair of integral wall units each including a rectangular side wall and an end wall having a rectangular bottom wall portion and a generally triangular gable portion, said gable portion being foldable along a horizontal line at the juncture with said bottom wall portion;

means for securing adjoining said wall units to one another in assembled relation so as to provide a wall structure with right angles between walls;

means on the underside of said roof panels and spaced apart from edges thereof for receiving upper edges of said side walls and end gables in forced-fit relationship; and said roof being adapted to form a storage receptacle for enclosing said wall units in folded, stacked relation therein.

2. A playhouse as defined in claim 1 wherein said means on the underside of said roof for receiving said edges comprises channels.

3. A playhouse as defined in claim 2 wherein said channels are defined by spaced-apart edges of strips of materials secured to the underside of said roof.

4. A playhouse as defined in claim 3 including a reinforcing rail disposed underneath edges of said roof around its periphery.

5. A playhouse as defined in claim 4 wherein said rail is formed integral with said roof by folding over edges thereof to provide a rail of triangular cross section.

6. A playhouse as defined in claim 5 wherein said means for adjoining said wall units to one another comprises a vertically extending strip secured to and foldable from a vertical edge of one of said units into overlapping relation with an edge portion of the adjacent unit and hook and loop fasterners secured to said strip and said edge portion.

7. A playhouse as defined in claim 1 wherein said roof and wall units are made of corrugated cardboard.

8. A foldable children's playhouse comprising:

an elongated box beam including a rectangular outer member and a pair of rectangular side members, each side member having an upper edge connected to a side edge of said outer member and a lower edge parallel to said upper edge; and a pair of rectangular panels, one of each foldably secured to a said lower edge and adapted to provide when said panels are unfolded to a position at a right angle to one another a roof and a first side wall;

a wall unit including a rectangular panel foldable along vertical lines to provide a front wall, a second side wall, and a back wall;

means on the underside of said roof for removably securing said roof to top edges of said front, rear, and second side walls;

means for securing vertical edges of said first side wall to edges of said front and rear walls;

said box beam and panels integral therewith being adapted, when folded shut, to provide a receptacle for enclosing said wall unit in folded condition.

* * * * *